US009044105B2

(12) United States Patent
McClaughry

(10) Patent No.: US 9,044,105 B2
(45) Date of Patent: Jun. 2, 2015

(54) ILLUMINATED DISPLAY FOR PACKAGED ITEMS

(71) Applicant: Tegrant Alloyd Brands, Inc., DeKalb, IL (US)

(72) Inventor: Thomas R. McClaughry, Chicago, IL (US)

(73) Assignee: Sonoco Development, Inc., Hartsville, SC (US)

( * ) Notice: Subject to any disclaimer, the term of this patent is extended or adjusted under 35 U.S.C. 154(b) by 218 days.

(21) Appl. No.: 13/662,944

(22) Filed: Oct. 29, 2012

(65) Prior Publication Data

US 2013/0107498 A1 May 2, 2013

Related U.S. Application Data

(60) Provisional application No. 61/553,774, filed on Oct. 31, 2011.

(51) Int. Cl.

| | |
|---|---|
| ***A47F 11/10*** | (2006.01) |
| ***A47F 3/00*** | (2006.01) |
| ***A47F 5/00*** | (2006.01) |
| *A47F 7/28* | (2006.01) |

(52) U.S. Cl.

CPC ..... *A47F 3/001* (2013.01); *A47F 5/005* (2013.01); *A47F 7/28* (2013.01); *B65D 2203/00* (2013.01)

(58) Field of Classification Search

CPC ..... A47F 3/001; A47F 5/005; A47F 5/0056; A47F 5/0062; A47F 5/0068; A47F 7/28; A47F 7/281; A47F 7/283; A47F 7/285; A47F 7/286; A47F 7/288; B65D 2203/00

USPC ..... 362/125, 253, 457–458

See application file for complete search history.

(56) References Cited

U.S. PATENT DOCUMENTS

| | | | | |
|---|---|---|---|---|
| 6,254,247 | B1 * | 7/2001 | Carson | 362/101 |
| 6,558,017 | B1 | 5/2003 | Saraiji et al. | |
| 7,597,448 | B1 | 10/2009 | Zarian | |
| 2007/0042614 | A1 | 2/2007 | Marmaropoulos et al. | |
| 2010/0087953 | A1 * | 4/2010 | Garson | 700/241 |
| 2011/0203148 | A1 | 8/2011 | Li et al. | |

OTHER PUBLICATIONS

International Search Report and Written Opinion issued in connection with International Patent Application No. PCT/US2012/062405 dated Jan. 8, 2013. 8 pages.

* cited by examiner

*Primary Examiner* — Jason Moon Han

(74) *Attorney, Agent, or Firm* — Dorsey & Whitney LLP

(57) ABSTRACT

A product display apparatus, has a tray with at least one station for receiving one or more products to be displayed, a directed illumination source in the at least one station for projecting light from the tray at a product received at the station, a product adapted for stable holding in the at least one station, and at least one light display element associated with the product, optically coupled to receive the projected light and to perform operations on the light received from the group consisting of: reflection, refraction, highlighting, backlighting, diffusion, concentration or combinations of the foregoing.

20 Claims, 11 Drawing Sheets

ILLUMINATED DISPLAY FOR PACKAGED ITEMS

TECHNICAL FIELD

The present disclosure is directed generally to product packaging, and more particularly to illumination of product packaging.

BACKGROUND

One consideration in successfully selling a product is to make the product for sale look appealing to and catch the attention of potential retail purchasers. One way to accomplish this is to use colors, shapes, unusual package designs, and lighting. For example, certain products have been sold in packaging that has a blinking light disposed on the outside of the package or on the outside of the product display, which may include the shelving on which the product is positioned.

It is also desirable to differentiate a particular product for sale from other products for sale. This has traditionally been done by marking the outside of the package with identifying information such as a trademark and description of the product. As designers of product packages become more creative, it has become increasingly challenging to distinguish a product from other products, to draw shopper attention.

The retail or wholesale store or other display site for products has traditionally provided the lighting that illuminates products on display. This leaves the provider of products without direct control of the light that falls on its products. The light may consistently be insufficient to make what the product provider considers to be an optimal visual impression. Or the lighting may vary based on where the products are displayed. Some display locations may provide illumination that is favorable to a product, whether that light is natural or artificial, while other display locations may have unfavorable light for product display. Seldom will a product provider be able to cause a display location to provide or provide consistently the lighting desired for the product. In addition, lighting will seldom be arranged to make a product provider's specific product stand out from others or to emphasize a specific product feature.

What is needed in the art is improved packaging using illumination for increased visual appeal and that allows the product provider to control at least aspects of the product illumination and to produce lighting effects specific to the product provider's products.

BRIEF SUMMARY

In one embodiment, disclosed herein is a packaging and display apparatus, comprising: a tray with at least one station for receiving one or more products to be displayed; a directed illumination source in the at least one station for projecting light from the tray at a product received at the station; a product adapted for stable holding at the at least one station; and at least one light display element associated with the product, optically coupled to receive the projected light and to perform operations on the light received from the group consisting of: reflection, refraction, highlighting, backlighting, diffusion, concentration or combinations of the foregoing.

Another embodiment disclosed herein is a package for use in a product display with a base with stations for receiving one or more products to be displayed and a directed illumination source in at least one station for projecting light from the tray into a package received at the station. The package comprises a package base adapted for stable holding in at least one station, said package, and at least one light display element in the package, optically coupled to receive projected light and to perform operations on light received from the group consisting of: reflection, refraction, highlighting, backlighting, diffusion, concentration or combinations of the foregoing.

In yet another embodiment, a method is disclosed for use in a product display with a base with stations for receiving one or more products to be displayed and a directed illumination source in at least one station for projecting light from the tray at a product received at the station. The method comprises inserting a product in at least one station; controlling the directed illumination source in the base to emit light directed at the product; and positioning in association with the product at least one light display element to receive light from the light source and to perform operations on the light received from the group consisting of: reflection, refraction, highlighting, backlighting, diffusion, concentration or combinations of the foregoing.

Additional advantages and novel features of the examples will be set forth in part in the description which follows, and in part will become apparent to those skilled in the art upon examination of the following description and the accompanying drawings or may be learned by production or operation of the examples. The advantages of the concepts may be realized and attained by means of the methodologies, instrumentalities and combinations particularly pointed out in the appended claims.

BRIEF DESCRIPTION OF DRAWINGS

The drawing figures depict one or more implementations in accordance with the present concepts, by way of example only, not by way of limitations. In the figures, like reference numerals refer to the same or similar elements.

DETAILED DESCRIPTION

Figure 4:
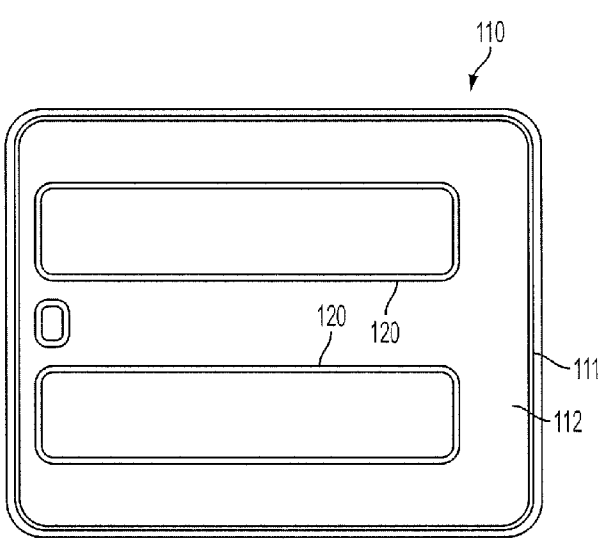
FIG. 4 is a top view of a tray bottom cover in accordance with the present disclosure.
Figure 5:
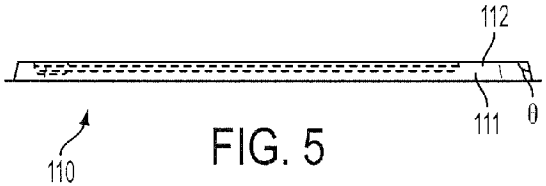
FIG. 5 is a side view of the tray bottom cover of FIG. 4.
Figure 2:
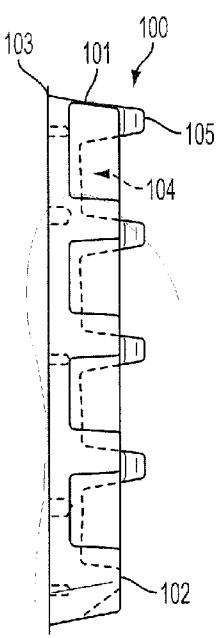
FIG. 2 is a side view of the tray of FIG. 1.

Overview.

The apparatus and method described herein provide a way to enhance display of products by illumination. As used herein, a "product" includes a bare product (e.g., an unwrapped bar of soap or tool), or one that includes a container (e.g., a liquid contained in a bottle) or other packaging, including both a container and additional packaging (e.g., a liquid contained in a bottle, which is contained in a box). To give the product provider the possibility of control over some aspects of product illumination, the apparatus and method contemplate a base tray that holds at one or more product stations one or more products or items to be sold. The base tray has one or more illumination sources built into it that are coordinated with the one or more product stations and with products. The illumination sources provide directed illumination that is projected onto or into one or more product items. In one embodiment, each product station of the base tray has an illumination source that provides directed illumination primarily to a product placed at the product station. A power and control circuit drives the one or more illumination sources. To take advantage of the directed illumination, the product has at least one light display element that interacts with the directed illumination. The interaction may be one or more optical effects that make the product more noticeable and appealing. The power and control circuit is controllable by the product provider; thus, the product provider has the ability to affect and, in particular to enhance, the illumination for a displayed product.

Base Tray and Cover.

Referring now to the FIGS. 1 through 10, a base tray 100 for displaying products 130 (see FIG. 8) is shown. The base tray 100 may include an outer wall or perimeter 101 and a top surface 102, the top surface 102 being integrally connected to the outer perimeter 101 at an angle θ (FIG. 5) that may be about 90 degrees or greater than about 90 degrees. In the example base tray 100 shown in the figures, the connection angle θ is about 100 degrees to facilitate stacking during manufacture and shipping. A flange 103 may extend from the outer perimeter 101 along an edge thereof opposite the top surface 102. The flange 103 may extend generally parallel to the top surface 102, thereby providing a support for the tray perimeter 101 as it would rest as part of an in-store display. The base tray 100 is preferably formed from a unitary piece of material, for example, thermoformed sheet material, although in some examples it may comprise several joined pieces. The base tray 100 may be manufactured from plastic, resin, glass, or other similar materials. Additionally, the tray 100 may include various adornments or decorative figures formed therein or attached thereto for further aesthetic appeal.

Figure 8:
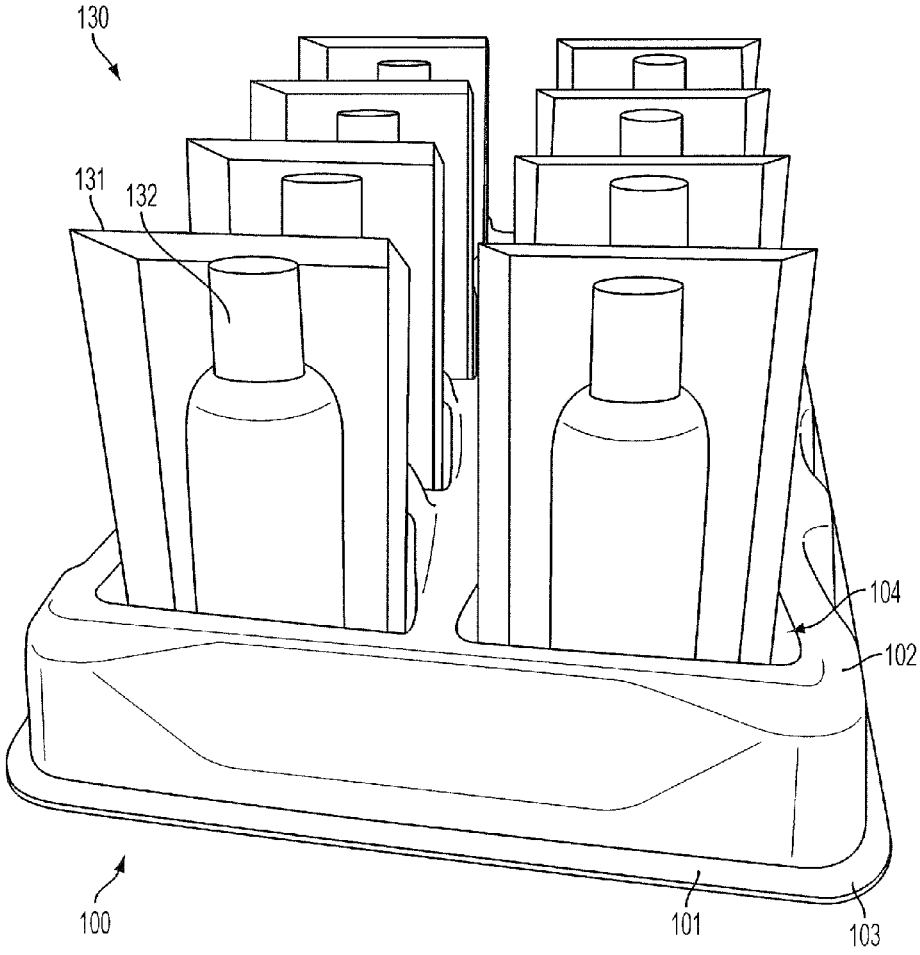
FIG. 8 shows the tray of FIG. 6, with packages inserted therein in a front view.
Figure 9:
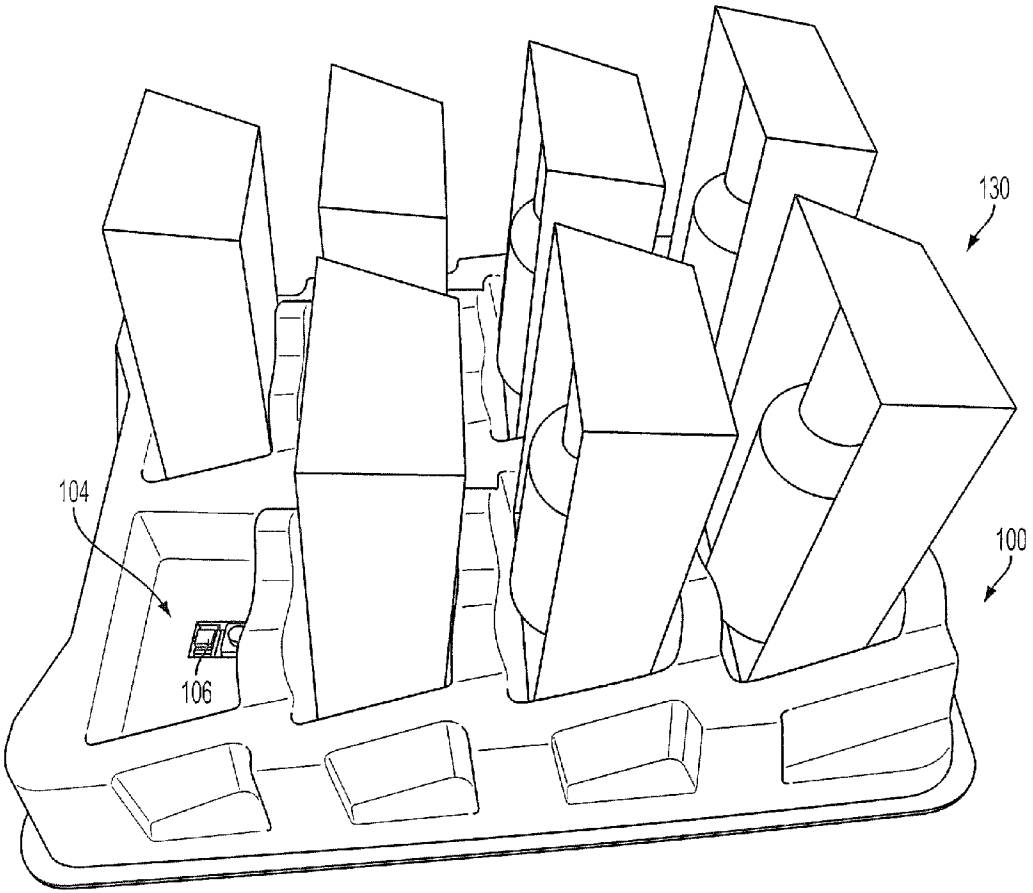
FIG. 9 shows the tray and packages of FIG. 8 in a side view.

Referring also to FIG. 8, the base tray 100 may be adapted to accommodate and retain a plurality of products 130. Products 130, which (as defined above, may include a container 131 and a contained product 132), may be inserted into or placed at a plurality of product stations, which may be in the form of recesses 104 formed in the top surface 102 (protrusions or markings may also define a station). A station provides stable holding of a product, while the product remains easily removable by a purchaser or service clerk. The depth of the recesses 104 may depend on the size and shape of the product to be inserted therein, but may generally be no deeper than the height of the outer perimeter 101, such that the tray is allowed to rest level on an in-store display surface, such as shelving. The shape of the recesses 104 may depend on the size and shape of the product to be inserted therein, and may be rectangular, trapezoidal, circular, oval, etc. A single recess may hold more than one product. As shown in the example embodiment of FIG. 1, the recesses 104 are trapezoidal, defined by an inner wall 107 having four sides. A bottom 109 of the recess 104 may be provided to support the product 130 inserted therein. Eight recesses are shown in the example in FIGS. 1-9.

In one example, a base tray 100 in accordance with the present disclosure may be made using a thermoforming process. Thermoforming, as used herein, generally refers to a manufacturing process where a plastic sheet is heated to a pliable forming temperature, formed to a specific shape in a mold, and additionally die cut and/or trimmed to create a usable product. The plastic sheet, or "film" when referring to thinner gauges and certain material types, is heated in an oven to a high-enough temperature that it can be pulled or pressed into or onto a mold and cooled to a finished shape. Thermoforming is suitable for use in high-volume applications, where production machines are utilized to heat and form the plastic sheet and trim the formed parts from the sheet in a continuous, high-speed process. This can produce many thousands of finished parts per hour, depending on the machine and mold size and the size of the parts being formed.

A high-volume, continuous thermoforming process of thin-gauge products may include a plastic sheet being fed from a roll or from an extruder into a set of indexing chains that incorporate pins, or spikes, or similar means that pierce the sheet and transport it through an oven for heating to forming temperature. The heated sheet then indexes into a form station where a mating mold and pressure-box close on the sheet, with vacuum then applied to remove trapped air and to pull the material into or onto the mold to form the plastic to the detailed shape of the mold. After a short forming cycle, a burst of reverse air pressure is actuated from the vacuum side of the mold as the form tooling opens, commonly referred to as air-eject, to break the vacuum and drive the formed parts off of, or out of, the mold. A stripper plate may also be utilized on the mold as it opens for ejection of more detailed parts or those with negative-draft, undercut areas. The sheet containing the formed parts then indexes into a trim station, where a die cuts the parts from the remaining sheet web, or indexes into a separate trim press where the formed parts are trimmed. The sheet web remaining after the formed parts are trimmed is typically wound onto a take-up reel or fed into an inline granulator for recycling.

As such, thermoforming is a process that uses minimal amounts of material, for example, thin film plastics as described above and is more environmentally friendly than many injection forming processes. It is also environmentally friendly in that it can use recycled materials, and can be configured to recycle excess or scrap material that results from the thermoforming process itself. Further, thermoforming is a fast, efficient, and highly repeatable process, capable of producing many components in a short amount of time, thus reducing manufacturing costs where a high volume of product is required. However, it may require significant design skill to produce a tray configuration that meets all the physical requirements and is also efficiently manufacturable by this process.

In examples where thermoforming is employed to produce the tray 100, the sheet stock and resulting trays may be made of any material suitable for use in thermoforming operations. These include, but are not limited to, PET, PVC, HIPS, HDPE, any other thermoplastic extrudable resin or bioplastics. Such materials may be substantially transparent, wherein the contents of the tray are visible therethrough. Alternatively, the material may be a non-transparent plastic. Various colors and printed design are also possible, which will be appreciated as allowing for enhanced branding capability. A typical thickness of the plastic sheet stock material used for the present tray 100 is about 0.015 to 0.500 inches or about 0.381 to 12.7 mm.

Of course, processes other than thermoforming are suitable for manufacturing the tray 100, such as molding, mechanical shaping, pressing, etc. Further, a tray may be formed from other materials, such as folded paperboard, formed metal sheets or assembled wood, metal or glass parts, The tray recesses 104 may include one or more apertures 106 for an illumination source, described further below, placed in or below the aperture. Apertures may include an opening formed in a portion of the recess bottom 109 and/or a portion of the recess inner wall 107. The opening may be left open, or may be filled with a lens or window, clear or adding a color or other quality to light passing through it, that protects or affects the light from the illumination source. The apertures 104 may be of any size, but may in one example be less than about $1/10^{th}$ of the recess 104 surface area (comprising the bottom 109 and inner wall 107), as shown in the example Figures. With an illumination source disposed in the void space 106 of the recesses 104, each recess 104 may generally be thought of as a "station" in which to receive a product 130 for controlled illumination thereof as described further below. In another embodiment, the tray has illumination sources supported on or in it, which are not associated with recesses and thus, may offer illumination to any surface or part of the tray or products supported on the tray.

The base tray 100 may optionally include one or more dividing portions 105 between the recesses 104. As shown in the FIGS. 1 and 3, a dividing portion 105, which may extend any height above the plane of the surface 102, is provided between each respective recess portion to support products 130 in place within the recesses 104, and to prevent the products from leaning against each other or otherwise being less than fully secured in place.

The base tray 100 may optionally include a bottom cover 110 for covering an underside relief 108 (see FIG. 7) of the base tray 100. Cover 110, as shown best in FIGS. 4, 5, and 7, may include an outer perimeter 111 and a planar surface 112. The height of the outer perimeter 111 of the cover 110 will generally be significantly less than the outer perimeter 101 of the tray 100, for example about ⅓ or less on a relative basis. The outer perimeter 111 may mate with the flange 103 and/or the outer perimeter 101 of the base tray 100, and the planar surface 112 may provide coverage over the underside relief 108 of the base tray 100.

Illumination Sources.

The tray is a platform for directed and controllable illumination sources and helps establish the interaction of such illumination sources and the light display elements associated with the illumination sources or with the tray.

Figure 11:
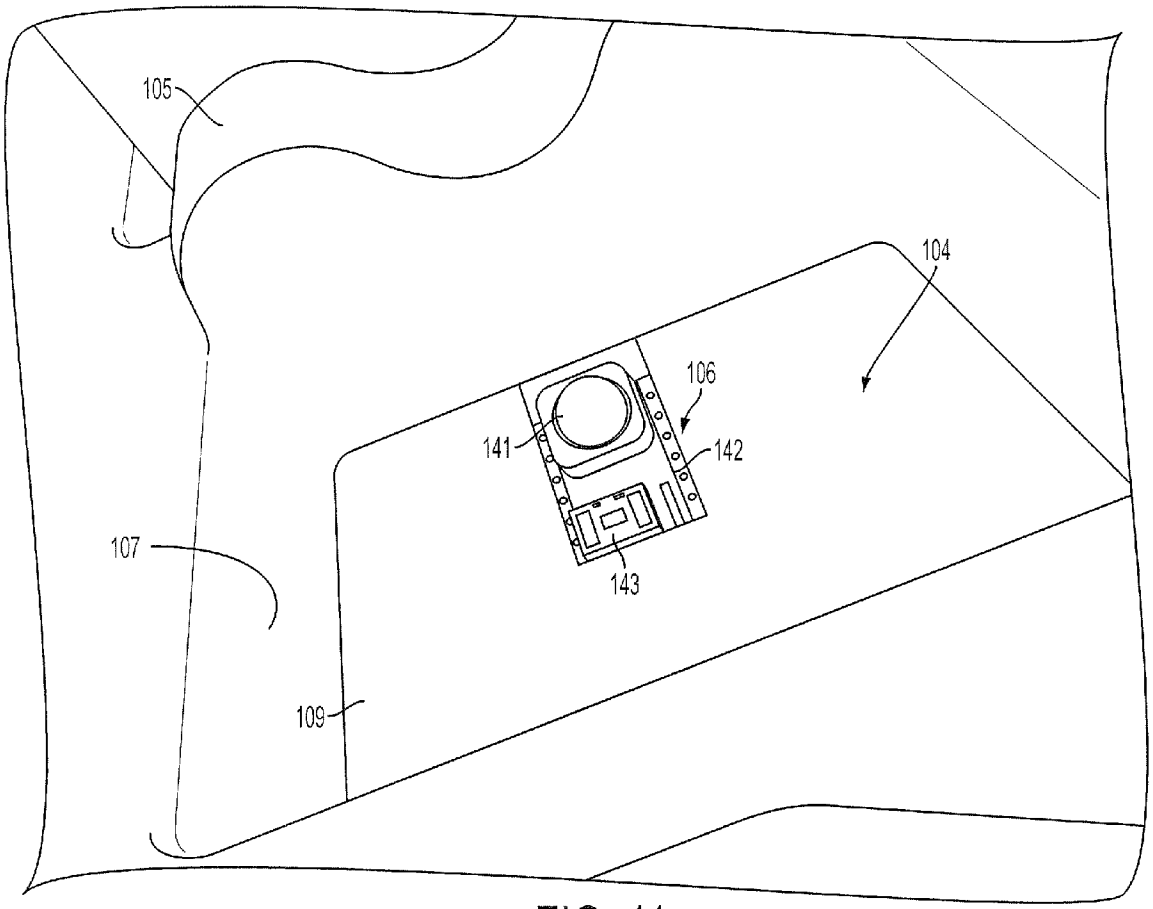
FIG. 11 is a detail view of a directed illumination source in accordance with the present disclosure.

Reference will now be made also to FIG. 11. Within and/or underneath and/or associated with an aperture 106 in a recess 104 may be provided one or more illumination sources 141. As such, the aperture 106 may act as a light supply point, allowing light to pass from the illumination source 141 to a product 130 at the station defined by the recess 104. An illumination source 141 may be any component capable of providing directed illumination, including but not limited to LEDs, which are typically made directional, providing a cone of light with defined angular qualities, or sources such as fluorescent lighting, incandescent lighting, phosphorescent lighting, and others that are equipped with lenses, reflectors, filters, or other devices that allow the direction, intensity and color of the light from the light source to be controlled. The example illumination source 141 shown in FIG. 11 is an LED light. LEDs are particularly suitable for the aforementioned operations. The optical properties of LEDs are variable by design, in that the lenses thereof (typically integrated with the device) are available with different viewing angles, whereby light is projected in a cone of a determined angle perpendicular from the emitting chip itself. This property is unique to LEDs and other semiconductor emitters (like laser diodes), because the light projection is mostly unidirectional as opposed to omnidirectional (like an incandescent or phosphorescent bulb). This allows for more precise direction of the light beam into the product 130 as may be selected, without reflectors or other add-ons. For example, a 10×10 mm blue SMD LED w/dome lens, part # ECB95W-2 purchased from eled.com is suitable.

The purpose of the directed illumination is to allow initial control of the illumination and thereby allow further control by use of light display elements that are selected and positioned to receive and perform a function that produces a desired display of light visible to at least some observers of a product associated with an illumination source 141.

Figure 10:
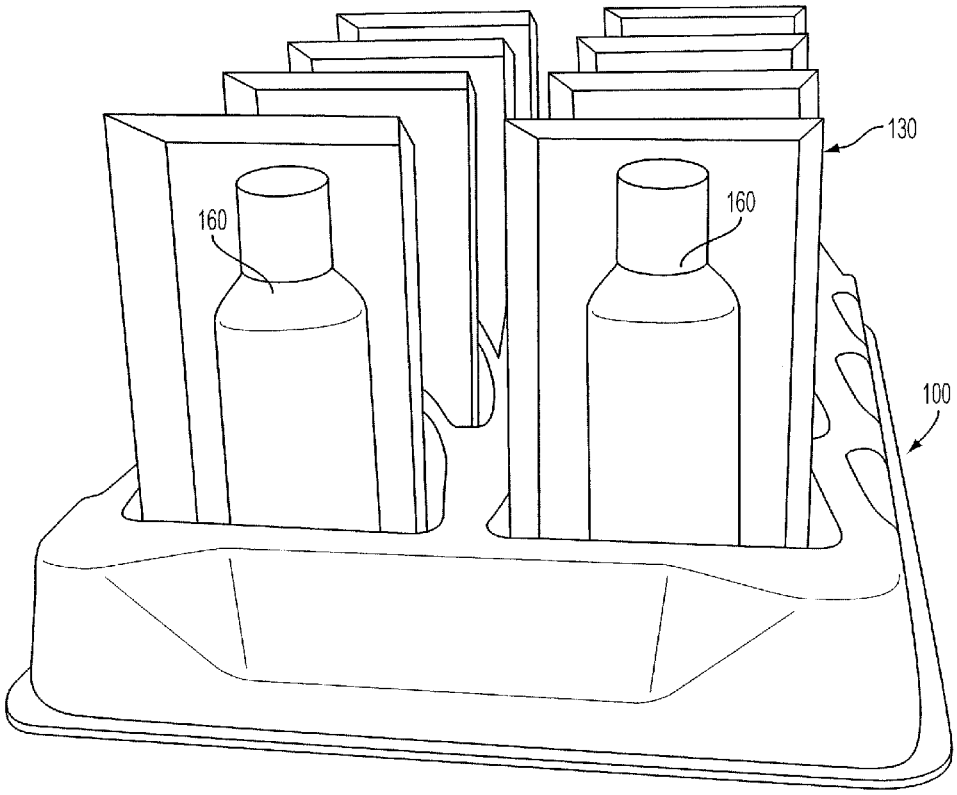
FIG. 10 shows the front view of FIG. 8 with the packages illuminated.

For example, as shown particularly in FIG. 10, upon illumination of one or more illumination sources 141 operably connected with the base tray 100 and associated with one or more recesses into which a blister package 130 containing a bottle 160 containing a liquid is placed, the packages 130 and bottles 160 receiving light appear to "illuminate" or "glow," thereby making them more noticeable and more attractive to the customers passing by such product display. This occurs by reason of the coordinated structure of the illumination source 141, delivering directed illumination from the base tray 100 to an associated product 130. At the associated product 130, the directed illumination encounters one or more light display features designed to interact with the directed illumination. In this case the product 130 has an aperture or window in its packaging (not shown in FIG. 10, see FIG. 13) that allows the directed illumination from an aperture 106 (not shown in FIG. 10) to enter the inside of the package. Here the in-streaming, directed illumination further enters the product bottle 160 and reaches the contained liquid, which diffuses the directed illumination. To further enhance the illumination of the product 130, a package wall may bear a holographic or reflective or refractive surface, which further enhances display of the directed illumination that enters the package. The observer of the product will see the resultant light redirected, refracted, reflected, and/or diffused by the light display features of the product, including its packaging. The product appears to glow, as a result of the illumination source 141 in base tray 100 and use of the light it emits at coordinated light display structures designed into a product 130, including the structure of its packaging. Light display structures may also be formed or placed on portions of the tray to which light is directed.

Power and Control Circuit.

Figure 1:
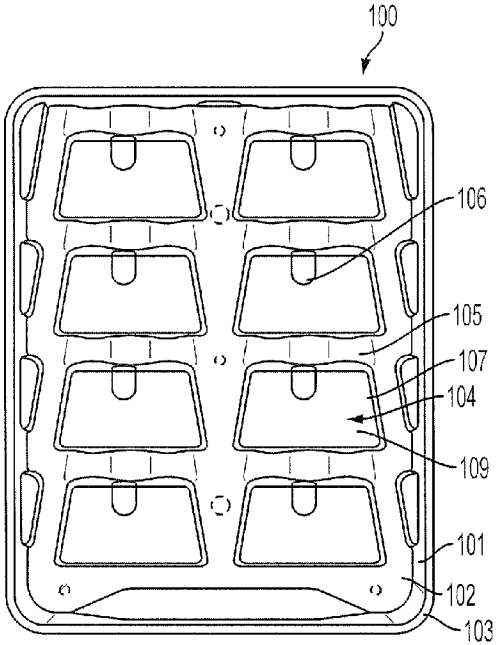
FIG. 1 is a top view of a tray in accordance with the present disclosure.
Figure 3:
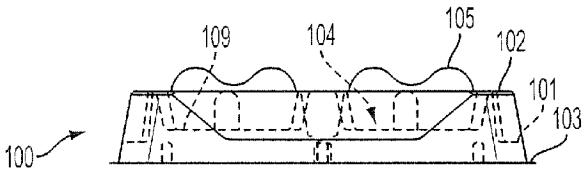
FIG. 3 is a front view of the tray of FIG. 1.
Figure 6:
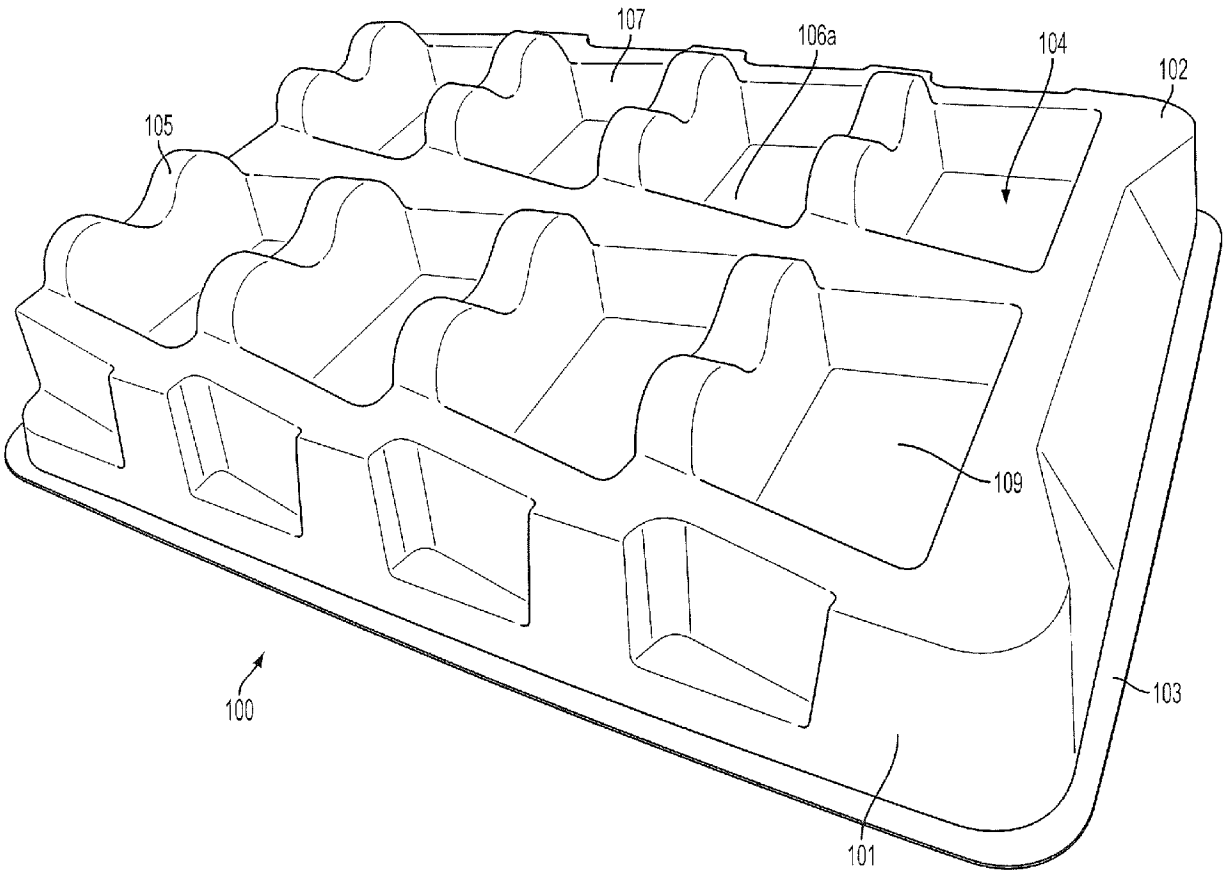
FIG. 6 is a perspective rendered view of a tray in accordance with the present disclosure.
Figure 7:
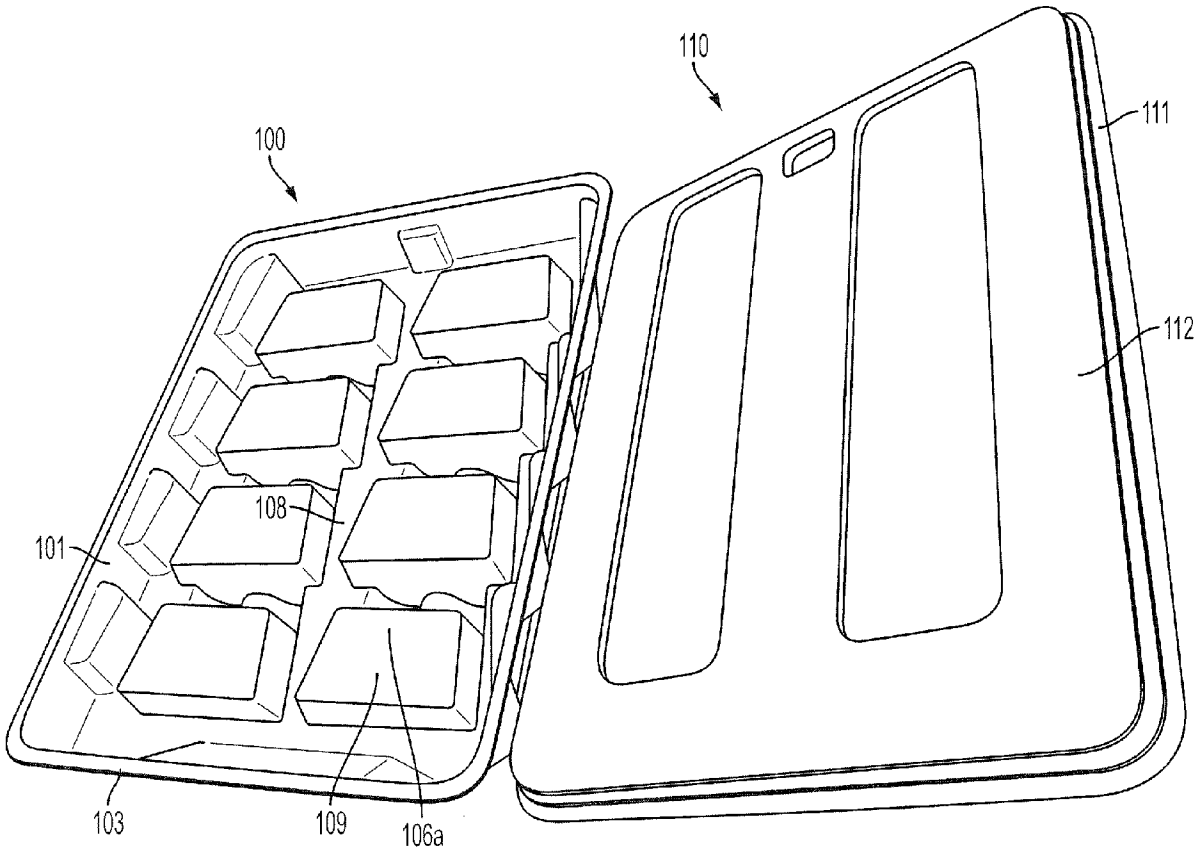
FIG. 7 is a perspective view of the underside of the tray of FIG. 6, along with a bottom cover therefor.
Figure 13:
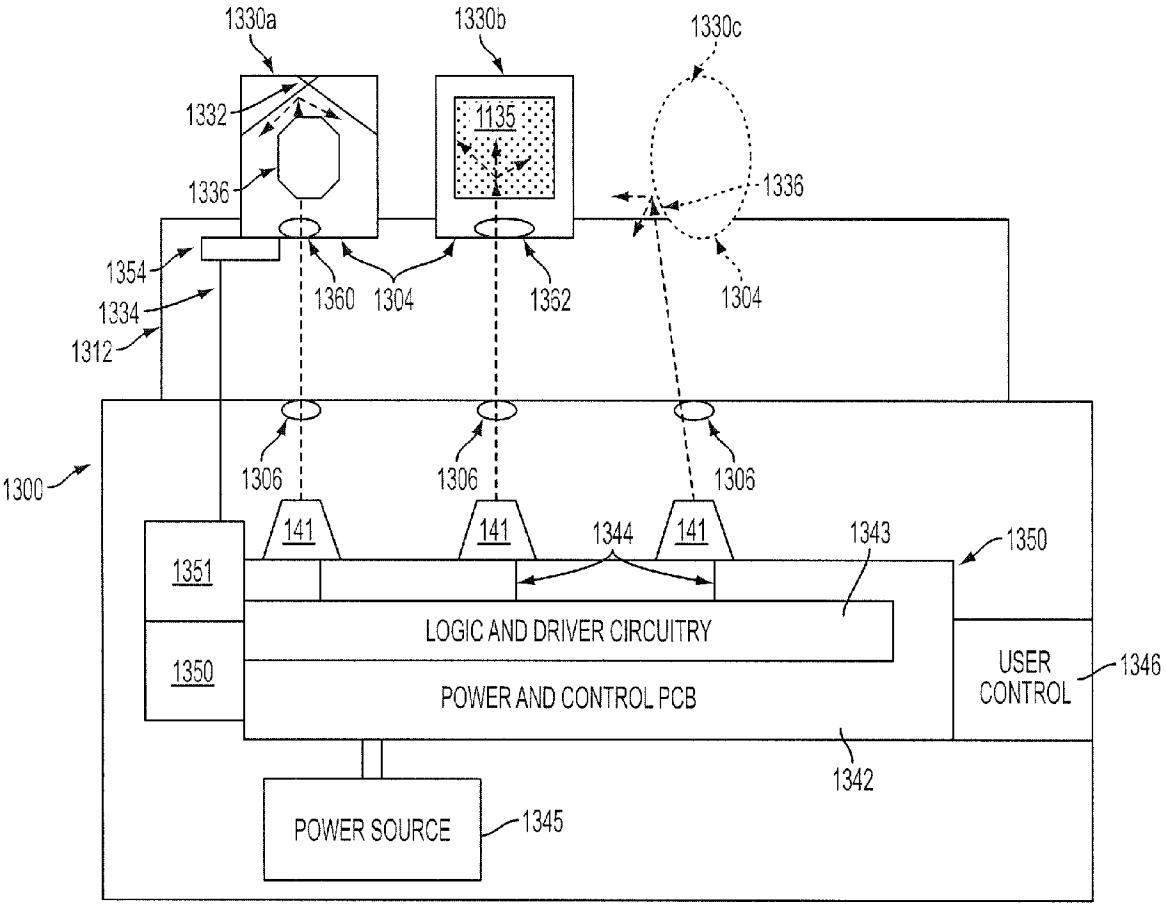
FIG. 13 is a schematic block diagram of the power and control circuitry in accordance with the present disclosure.

As seen in FIG. 13, one or more illumination sources 141 may be powered and controlled by a power and control circuit 1350 that may be built into a base tray 1300 or may be otherwise operably connected with the one or more illumination sources 141 of a base tray. (In another embodiment, each of the one or more illumination sources 141 may have its own power and control circuit 1350.) As seen in FIG. 13, the power and control circuit 1350 has a power source 1345, which is operably connected to a power and control printed circuit board 1342 which carries the one or more illumination sources 141 (only three are shown, as examples) and which also supplies power to the logic and driver circuitry 1343 on printed circuit board 1342 and its components; thus, the power source 1345 provides power to the logic and driver circuitry 1343 and ultimately to the illumination sources 141, under control of the logic and driver circuitry 1343. An illumination source 141 may be operably connected for driving by an electrical connection means, such as the conductive paths 1344 of a circuit board 1342 or by wires. To supply illumination to multiple product stations, one or more circuit boards 1342 may be mounted in mounting pockets 120 of the base cover; see also reference nos. 110, 120 in FIG. 4. If the circuit board 1342 is made to span from the back product stations to the front product stations (as seen in FIG. 1), multiple illumination source 141 may be mounted on it, corresponding to the location of one or more apertures 106 in the recesses 104. Alternatively, the illumination sources 141 may be separate units which may be mounted on the underside of the recess bottom 109, to fit the individual apertures 106 and direct light upwardly into a recess 104 forming a product station, illuminating any products 130 placed therein; see FIGS. 4, 11.

Referring again to FIG. 13, each aperture 106 in a base tray 1300 can be adapted to receive at least one of the illumination sources 141, which is in turn connected to common logic and driver circuitry 1343. Where an LED light is employed as an illumination source, its base or leads may act as a heat sink for the LED light, should that be necessary.

The circuit board 1342 may be connected to the base tray cover (see also FIG. 2, at 110) in a mounting pocket 120 as described above by, for example, welding, glues, adhesives, fasteners, screws and the like. One or more connection means may be used. The connection means and possible venting of the tray should take into account the heat that will be generated by the illumination sources 141 (for example, an LED implementation should not use a low melting temperature adhesive near the LED, so as to prevent accidental melting and disassociation during use).

The power source 1345 may either be an internally located powered source or an external power source, or a power converter for use in connection with either. The power source 1345 can be DC voltage or AC voltage converted to DC. The energy source can be chemical energy (from a dry cell, for example), light energy (from photoelectric cells), or induced energy (from coils or other generators of an electro-magnetic field). In one embodiment, the energy source is a power supply with a transformer and one or more components to step down, smooth or otherwise regulate and supply one of more the voltages needed by the LEDs or other components. The power source 1345 may be located anywhere within or outside of the base tray 1300. The power source 1345 may be mounted into the relief 108 (see FIG. 7) formed in the underside of the base tray 100. The cover 110 (see FIG. 7) may conceal the illumination source 141/power source 145/board 142 (see FIG. 11) where provided.

Figure 12:
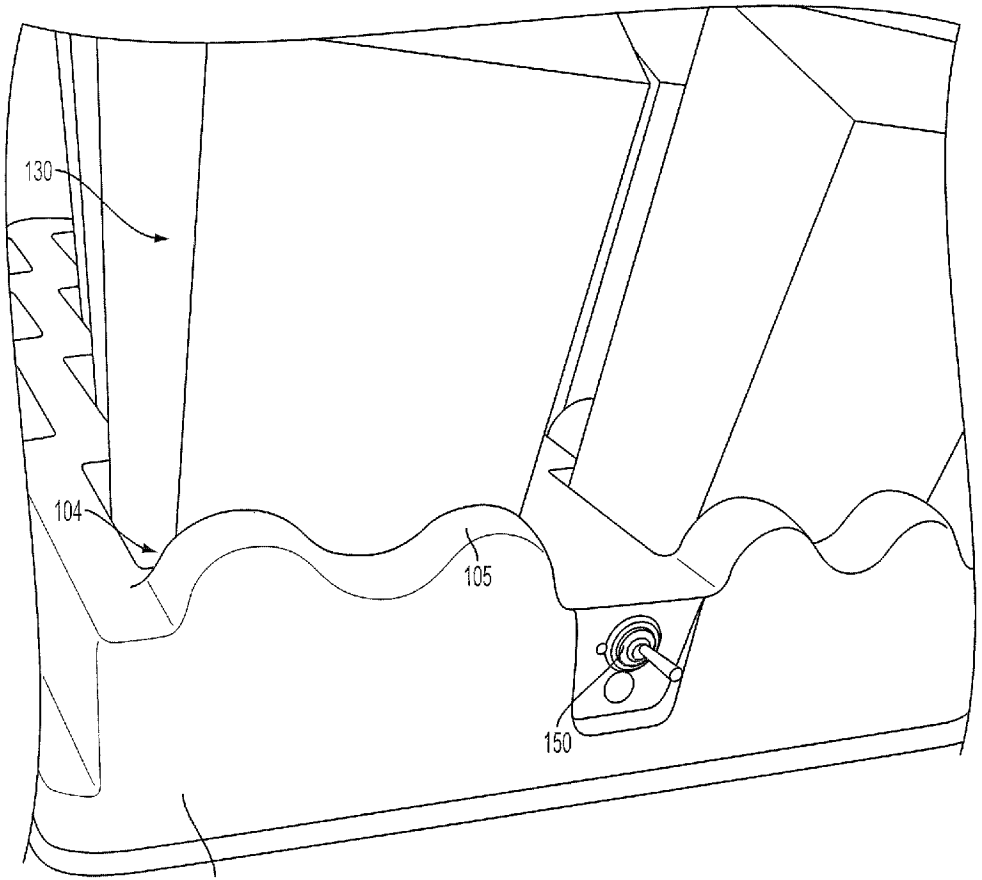
FIG. 12 is a rear view of the tray as in FIG. 8, showing an illumination switch.

A switch 150, which may be in the form of a toggle switch, button, knob, etc. (a toggle switch is shown in FIG. 12) may be provided and operably connected to the power source 145 (or 1345) or the circuit board 1342 that drives one or more illumination sources 141. The switch 150 may operate to selectively control power from the power source 1345 to the logic and driver circuitry 1343. Thus, switch 150 may provide overall control and is optional.

With reference to FIG. 13, the circuit board 1342 may include logic and driver circuitry 1343 (discrete logic or a programmed microprocessor or other configurable circuitry) that may provide additional control over the associated illumination source(s) 141. Logic and driver circuitry 1343 can be configured to control the pattern, color, intensity, activation, and other controllable qualities of the illumination sources 141. For example, individual illumination sources 141 may be controlled to blink or blink in a pattern, and multiple illumination sources may be driven to provide light in a sequence or in some other attention-getting pattern. Where an illumination source of a particular color is available, it may be activated or not. The logic and driver circuitry 1343 may be connected to a user selector or control interface 1346 to allow the user to control the pattern, color, intensity, activation, and other qualities of the illumination, via a selection actuator of the interface 1346, which also may be associated with a user status or option display (e.g. an LED group or LED screen, not shown). In some embodiments, one or more sensors 1351 may also be provided to detect a condition, such as ambient lighting conditions, proximity of a customer near the tray, presence or absence of product in a recess, or other environmental or sensed conditions. The outputs of the sensor(s) may become inputs to the logic and driver circuitry 1343, for use in controlling the illumination and its aforementioned qualities or functions. For example, each product station may have an actuator that senses product and controls one or more illumination sources at a product station. This ensures illumination is used only when there is a product to receive it.

For example, in FIG. 13, the product 1330*a* in leftmost recess 1304 has a sensor 1354 (such as a pressure sensitive switch or a photodetector) to detect when a product is present in the recess 1304. When no product is present, this sensed condition may be communicated to the logic and driver circuitry 1343 via communication line 1334 and may cause the illumination source 141 at that recess to be disabled, or other action taken per user programming of the logic and driver circuitry 1343 to respond to the sensor state.

Light Display Elements.

Figure 15:
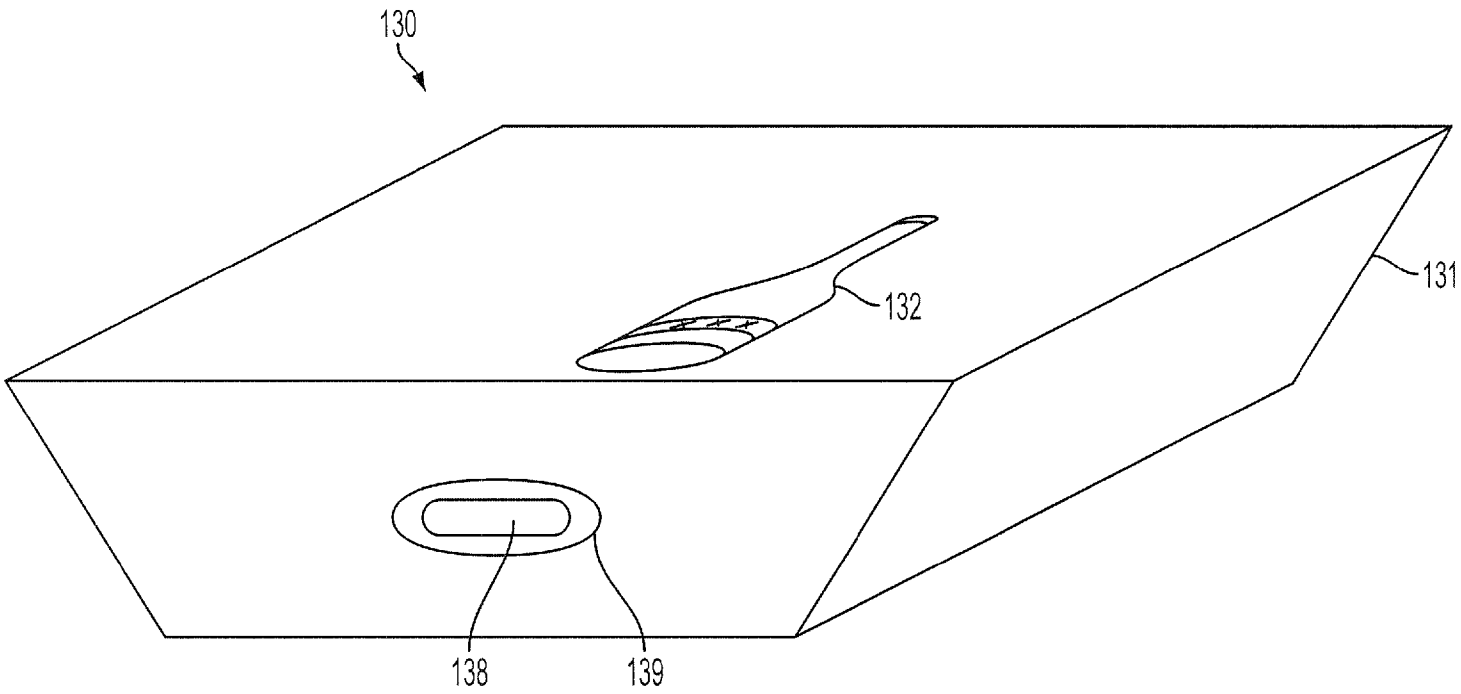
FIG. 15 shows the bottom portion of an example package in accordance with the present disclosure.

The delivery of light to a product 130 (FIG. 9), 1330*a*, 1330*b* or 1330*c* (FIG. 13) in one of recesses 1304 or to a tray surface or feature from an illumination source 141 may enable a wide variety of visual effects. Those effects may be rendered not only by control of the illumination sources 141, which may provide control for illumination of individual products or product packaging, but by the elements of a product that receives illumination, including the product packaging. Thus, the product may be designed to include various light display elements selected and configured to interact with the directed illumination to provide various different visual effects. One basic choice is whether the light is used on the outside of the product or the inside or both. If lighting effects are desired with a product, a useful light display element is one that allows or leads light from an illumination source 141 into the product or its product packaging. With reference now to FIG. 15, to receive light to illuminate the product 130, the container portion 131 thereof may include a light entry point 139. The light entry point may be a small cut out, a transparent material, a translucent material, a light transmitting material, a lens or any other material to allow light to pass therethrough, from the illumination source 141 at which the light entry portion 139 is configured to be positioned. Alternatively, the entire container 131 or certain surface of it may be made of a transparent, translucent, or other light permitting material so as to obviate the need for a separate light entry point 139. The illumination source may be placed to be adjacent a corresponding light entry point of a package at a station for optical coupling of the projected light to the interior of the package.

The product 130, including product packaging 131 may be configured so as to perform display operations on the light received, e.g., so as to better project/direct the light to or from the product, including but not limited to: reflection, refraction, highlighting, backlighting, diffusion, concentration. As such, a light display element may be included in one or more of the bare product, a container or the packaging thereof). A light display element 138 is shown in proximity to the light entry point 139 in the example of FIG. 15. Of course, a light display element can be positioned anywhere else, as desired to effect the light display functions listed above, and as will now be discussed in greater detail below.

Reflection is the change in direction of a wavefront at an interface between two different media so that the wave front returns into the medium from which it originated. The wavefront in this instance is a light wave from the directed illumination. Light display elements 138 that may cause reflection include, but are not limited to, a mirror component, a reflective lens or liquid medium (for example liquid that may be contained within the product 132), among other things. A particular example of reflection includes the positioning of a reflective display element 138 within the package 130 to direct the light to a particular point within the package for best product emphasis.

Refraction is the change in direction of a wave due to a change in its speed. Light display elements 138 that may cause refraction include, but are not limited to, a mirror component, a thermoplastic material, a shaped lens, a liquid medium (for example liquid that may be contained within the product 132), among other things. A particular example of refraction includes the bending of light through a an optical medium, to either change the direction of light to a desired point, or to change the wavelength of light to change the color of the illumination (or both).

It will be appreciated that where a shaped lens is used, such lens may be of any shape, and the selection thereof will depend on the desired display operation to which the light is to be subjected. The lens may be flat, convex, concave, prismoid, or otherwise shaped. In one particular example, a Fresnel lens, as will be appreciated by those having ordinary skill in the art, comprises a thin optical lens consisting of concentric rings of segmental lenses and having a short focal length. The Fresnel lens reduces the amount of material required compared to a conventional spherical lens by dividing the lens into a set of concentric annular sections. Such a lens may be implemented in a relatively thin film.

Highlighting generally includes the focusing of light at a particular point, to cause attention to be drawn to such point. Light display elements 138 that may cause highlighting include, but are not limited to, a focusing mirror component, a thermoplastic material, a shaped lens, a liquid medium (for example liquid that may be contained within the product 132), among other things. A particular example of highlighting may include directing light to the brand name portion of a product so as to enhance brand value.

Backlighting generally includes causing light to emanate from behind an object (such as the product 132) desired to be backlit. Light display elements 138 that may cause backlighting include, but are not limited to, a mirror component, a thermoplastic material, a shaped lens, a liquid medium (for example liquid that may be contained within the product 132), among other things. A particular example of backlighting includes the backlighting of a translucent product 132, so as to cause the product to have a "glowing" effect as shown in FIG. 10, which calls greater attention to the product.

Diffusion is a phenomena where photons (light particles) travel through a material without being absorbed, but rather undergoing repeated scattering events that change the direction of their path. Light display elements 138 that may cause diffusion include, but are not limited to, a minor component, a thermoplastic material, a shaped lens, a liquid medium (for example liquid that may be contained within the product 132), among other things. A particular example of diffusion includes the diffusion within a liquid product 132, so as to cause the product that receives light from an illumination source 141 to have a "glowing" effect as shown in FIG. 10, which calls greater attention to the product.

Concentration refers generally to the focusing of a relatively wider beam of light into a relatively smaller beam of light, for example to emphasis a particular point of focus. Light display elements 138 that may cause concentration include, but are not limited to, a mirror component, a shaped lens, a liquid medium (for example liquid that may be shaped by packaging of the product 132), among other things. A particular example of concentration may include concentrating light on the brand name portion of a product display or package so as to evoke brand value.

By equipping portions of the tray 1300 with a light display feature, directed illumination also can produce effects at the tray, not just at the products. For example, a logo at the front of a tray may be illuminated by receiving light from an illumination source. The logo may be constructed from a material that causes reflection, refraction, highlighting, backlighting, diffusion, concentration.

Referring again to FIG. 13, an illuminated base tray 1300 and associated products 1300*a*, 1300*b*, 1300*c* with light display elements coordinated with the illumination sources may be used as a display to facilitate in-store sales of the products. Illumination may enhance the appearance of tray 1300 and/or products 1300*a*, 1300*b*, 1300*c*, drawing customers to the display and providing an incentive to purchase the products 1300*a*, 1300*b*, 1300*c*. In FIG. 13, product 1330*a* has a contained item 1336 that may receive illumination emitted from tray 1300 via aperture 1306 and entering product 1330*a* at an aperture 1360 to then strike a facet of item 1336, which may reflect or simply be more visible. Where item 1336 transmits light, light traveling through it may encounter light display elements, comprising a pair of angled surface 1332 at which reflection and/or refraction may occur. In FIG. 13, product 1330*b* may include a contained volume of liquid 1135. Here, the liquid 1135 may receive illumination emitted from tray 1300 via aperture 1306 and entering product 1330*b* at a lens-containing aperture 1362 where it may be either spread or concentrated before entering the liquid 1135, which causes diffusion, either by its nature or by an ingredient that enhances diffusion, such as glitter particles. In FIG. 13, product 1330*c* may have an exterior surface that it is enhanced with, e.g., a holographic image 1336 coordinated to receive illumination emitted from tray 1300 via aperture 1306 and striking product 1330*c* at the holographic image 1336, which is thereby made prominent.

It will be appreciated that any one or more of the above-discussed effect may be provided by selected light display element(s) coordinated with illumination sources and appropriate light paths. The implementation of a suitable light display element may follow the above principles for a variety of product illumination applications. It will also be appreciated that the interior geometry and surfaces of a recess 104 or 1304 can be configured with light display elements, alone or by combinations, so as to cause desired lighting effects.

It will also be appreciated that the product's 130 optical properties will change depending on the item 132 contained therein. Because many product shapes are different, it is anticipated that the product 130, including the size, shape, and light display elements included therewith, will be modified and adapted to suit the shape and properties of the particular item being packaged and any associated container. It is generally desirable for the light to enter inside of the product's package and interact with the product, its package and/or container in such a way as to create "shelf appeal." In the example shown in FIG. 10, the illumination enters the box and is directed primarily into the base of the "bottle," (with liquid contained), using the liquid product 132 itself as a diffusion medium (see discussion of diffusion above), causing the whole product 130, and especially the liquid 132, to glow.

In a further example, holographic paper for insertion within the container 131 may be provided so as to exploit the illumination provided, but without otherwise interfering with the light-directing configuration of the particular package 130. An inserted light display element can be holographic, foil-coated, matte-finished, or a surface having any sort of treatment that interacts with light and does not impair the light going through the package, but can be used to direct or change light in a way that affects the product appearance to the consumer.

In a further example, where a larger product is intended to be illuminated than, for example, those shown in the Figures, it may be desirable to diffuse light from a small illumination source 141 (or multiple sources) over a larger area, requiring refractive and/or reflective substrates to be used at or near the light entry point adjacent to the base of the product to project the light all around the inside of the product package 130.

Alternatives.

Figure 14:
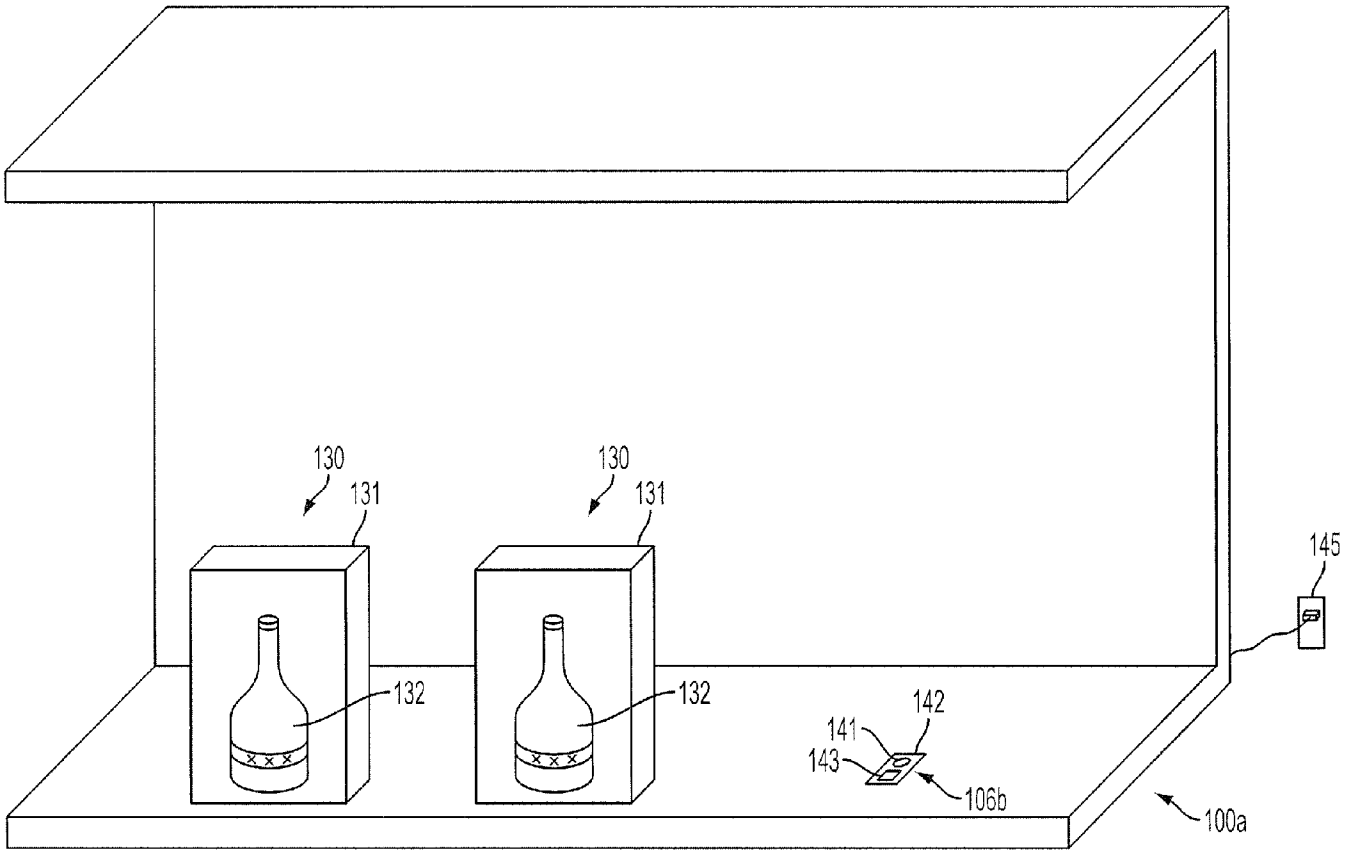
FIG. 14 is an alternative illuminated tray and package configuration configured as a shell.

In an alternative embodiment shown in FIG. 14, the tray may be embodied as a shelf 100*a* or other in-store display surface. The shelf 100*a* may include a similar void 106*b* for receiving the illumination source 141. Products would be placed on the shelf 100*a* as is typical in retail environments, however with the illumination source 141 therebelow, the products 130 may be illuminated as in FIG. 10.

The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A product display apparatus, comprising:

a tray with a plurality of product stations comprising at least one of a recess or a protrusion for receiving and stably holding a base of at least one product for controlled illumination thereof;

a directed illumination source in each of the product stations for directing projected light from the tray at a product received at the station, each said illumination source being selectively controllable by a control system that detects the presence or absence of the product received at the station and controls the illumination at the station in response thereto; and at least one light display element associated with each product, each product being optically coupled to receive the projected light at its station and to perform operations on the light received from the group consisting of: reflection, refraction, highlighting, backlighting, diffusion, concentration or combinations of the foregoing, wherein the plurality of product stations of the tray establishes interaction of the illumination source and the light display element to allow initial control of illumination of the at least one light display element of a received product.

2. The product display apparatus of claim 1 wherein each product comprises a package having at least one light entry point for receiving light from the directed illumination source.

3. The product display apparatus of claim 1 wherein each product comprises a material positioned for receiving light from the directed illumination source.

4. The product display apparatus of claim 1, further comprising driver circuitry configured to provide selective control of the pattern, color, intensity, activation, and other controllable qualities of each illumination source.

5. The product display apparatus of claim 1, wherein the tray further comprises a dividing portion that prevents a product received at a first station of the plurality of stations from leaning against a product received at a second station of the plurality of stations.

6. The product display apparatus of claim 1, wherein the illumination source is an LED.

7. The product display apparatus of claim 1, wherein the product comprises a liquid in a container and the at least one light display element is that the liquid diffuses light it receives.

8. The product display apparatus of claim 1 wherein the plurality of product stations comprises a plurality of recesses formed in the tray.

9. The product display apparatus of claim 1 wherein the plurality of product stations comprises a plurality of recesses formed in the tray, each with a size and shape to hold the product inserted therein.

10. A package for use in a product display with a base with a plurality of product stations, each comprising at least one of a recess or a protrusion for receiving and stably holding one or more products to be displayed and having a directed illumination source in the station responsive to the presence or absence of the product at the station for directing projected light from a tray into a package received at the station, said package comprising:

a package base adapted for stable holding in one of the plurality of product stations; and at least one light display element in the package, optically coupled to receive projected light from the illumination source, the plurality of product stations of the tray establishing interaction of the illumination source and the light display element to allow initial control of illumination of the package and the light display element being selected and positioned to perform operations on light received and produce a desired display of light visible to at least some observers of the package, the operations selected from the group consisting of: reflection, refraction, highlighting, backlighting, diffusion, concentration or combinations of the foregoing.

11. The package of claim 10, further comprising at least one light entry point for receiving light from a directed illumination source in at least one station and a lens optically coupled to the light entry point and positioned to receive projected light.

12. The package of claim 10 further comprising a holographic image optically coupled to receive projected light from the illumination source.

13. The package of claim 10 wherein the product comprises a liquid in a container optically coupled to receive and diffuse projected light from the illumination source.

14. A product display apparatus, comprising:

a tray with a plurality of stations, each station comprising at least one of a recess or a protrusion for receiving and stably holding a base of at least one or more products to be displayed;

a directed illumination source in each of the plurality of stations for directing projected light from the tray at a product received at the station, said projected light being selectively controllable at the station and directed for optically coupling to the product to receive the projected light at a light display element to perform operations on the light received from the group consisting of: reflection, refraction, highlighting, backlighting, diffusion, concentration or combinations of the foregoing; and a control system that detects the presence or absence of the product received at the station and controls the illumination source in the station in response thereto.

15. The product display apparatus of claim 14 wherein each product comprises a package having at least one light entry point for receiving light from the directed illumination source.

16. The product display apparatus of claim 14, further comprising driver circuitry configured to selectively control the pattern, color, intensity, activation, and other controllable qualities of the illumination source.

17. The product display apparatus of claim 14, wherein the material of the tray is thermoplastic.

18. The product display apparatus of claim 14, wherein each illumination source is an LED.

19. The product display apparatus of claim 14, wherein each illumination source is placed to be adjacent a corresponding light entry point of a product and/or package at a station for optical coupling of the projected light to the interior of the product and/or package.

20. The product display apparatus of claim 14, wherein the tray further comprises a dividing portion that prevents a product received at a first station of the plurality of stations from leaning against a product received at a second station of the plurality of stations.

* * * * *